US005993892A

United States Patent [19]

Wasserman et al.

[11] Patent Number: 5,993,892

[45] **Date of Patent: *Nov. 30, 1999**

[54] METHOD OF MONITORING AND CONTROLLING ELECTROLESS PLATING IN REAL TIME

[76] Inventors: Arthur Wasserman, 35 E. 35th St., Box 6E, New York, N.Y. 10016; Richard Smith, 65 St. Mark's Pl., New York, N.Y. 10003

[ * ] Notice: This patent issued on a continued prosecution application filed under 37 CFR 1.53(d), and is subject to the twenty year patent term provisions of 35 U.S.C. 154(a)(2).

[21] Appl. No.: 08/713,265

[22] Filed: Sep. 12, 1996

[51] Int. Cl.[6] ..... B05D 1/18; B05D 1/00

[52] U.S. Cl. ..... 427/8; 427/9; 427/443.1

[58] Field of Search ..... 427/8, 9, 443.1, 427/443.2

[56] References Cited

U.S. PATENT DOCUMENTS

| | | | |
|---|---|---|---|
| 2,532,283 | 12/1950 | Brenner et al. | 117/50 |
| 2,532,284 | 12/1950 | Brenner et al. | 117/50 |
| 2,658,842 | 11/1953 | Gutzeit et al. | 117/130 |
| 2,978,364 | 4/1961 | Blaustein | 117/227 |
| 3,934,054 | 1/1976 | Shmeling et al. | 427/8 |
| 4,096,301 | 6/1978 | Slominski et al. | 427/430 A |
| 4,125,642 | 11/1978 | Petit et al. | 427/8 |
| 4,135,006 | 1/1979 | Readal et al. | 427/10 |
| 4,331,699 | 5/1982 | Suzuki et al. | 427/8 |
| 4,350,717 | 9/1982 | Araki et al. | 427/8 |
| 4,353,933 | 10/1982 | Araki et al. | 427/8 |
| 4,479,980 | 10/1984 | Acosta et al. | 427/10 |
| 4,623,554 | 11/1986 | Kaschak et al. | 427/8 |
| 4,626,446 | 12/1986 | Capwell et al. | 427/8 |
| 4,681,817 | 7/1987 | Shinada | 428/549 |
| 4,755,744 | 7/1988 | Moore et al. | 324/65 CR |
| 4,756,190 | 7/1988 | Ohta et al. | 73/204 |
| 4,774,101 | 9/1988 | Harris et al. | 427/8 |
| 4,794,797 | 1/1989 | Ogawa | 73/786 |
| 4,814,197 | 3/1989 | Duffy et al. | 427/8 |
| 4,986,130 | 1/1991 | Engelhaupt et al. | 73/760 |
| 5,108,552 | 4/1992 | Desthomas | 205/82 |
| 5,182,131 | 1/1993 | Hashimoto et al. | 427/8 |
| 5,248,853 | 9/1993 | Ishikawa et al. | 174/256 |
| 5,270,659 | 12/1993 | Toyoda et al. | 324/444 |
| 5,368,715 | 11/1994 | Hurley et al. | 205/82 |

*Primary Examiner*—Shrive Beck
*Assistant Examiner*—Michael Barr

[57] ABSTRACT

A sample coupon of known dimensions is immersed in the electroless plating bath. Immersion time can extend for the life of the bath. The coupon is attached to a load-cell which incorporates strain-gauge technology. The millivolt output of the load-cell to galvanometer displays weight gain at chosen intervals (e.g., 1 minute), and can signal operator if weight gain is less than the chart contained in engineering specifications to make replenishment additions defined in specification. The galvanometer output, with specialized software to computer traces weight gain profile providing data for actuating valves (e.g., proportionating pump) and provides hard-copy quality control record. Control of this one chemical replenishment parameter is sufficient to give real time process optimization and minimizes auto-catalytic breakdown. Instruments can be positioned in controlled environment.

4 Claims, 6 Drawing Sheets

SERVO-CONTROLS WITH LOAD CELL

Strain gauge circuit.

SERVO-CONTROLS WITH LOAD CELL

SERVO-CONTROLS FOR TEMPERATURE, PH + WEIGHT

SERIES CONNECTION

WEIR

PROFILE OF MANUAL(1), AUTOMATIC(2) AND STEADY STATE(3) REPLENISHER ADDITIONS.

CONTROL PROFILE OF REPLENISHER ADDITIONS.

METHOD OF MONITORING AND CONTROLLING ELECTROLESS PLATING IN REAL TIME

SUMMARY OF INTERVENTION

Electroless plating is an auto-catalytic chemical process that deposits a metal or an alloy.

As employed in industry, it is characterized by enhancing corrosion resistance, wear properties and providing electrical conductivity to defined areas.

It has the ability of depositing an exact thickness of metal on parts regardless of the parts' shape or their position in the electroless plating tank.

However, while the deposition thickness is exact throughout, the rate of deposition changes during the plating process.

For the following reasons:

Metal is plating out of the solution

Ph changes (decreases)

Chemicals used to reduce the metal from the solution on the part, e.g., Sodium Hypophosphite is oxidized thereby losing this property.

Temperature of the plating solution varies due to the insertion and withdrawal of pieces requiring plating Multiple chemical changes in the plating solution [e.g., exaltants (Succinic Acid)] concentration is reduced by "drag-out" with parts being removed.

Determination of the deposition rate is the primary parameter for process and quality control:

To define problem and potential problem areas

And to finish the task expediently.

Present methods of determining process rate depend on removing coupons from the electroless plating process at noted time sequences and measuring either thickness of deposit or deposit weight. These results are logged in by operator.

If deposition rate changes results are production delays and deposit defects.

By employing the teachings of this invention, process deposition rate is immediately displayed, providing direction for immediate process intervention in real time, e.g., by Adding replenisher chemicals.

The ability to replenish chemicals in real time augments existing capability to read ph and temperature in real time, the totality of which guides adjustments. Besides insuring optimum deposition rates, real time information helps prevent autocatalytic solution decomposition.

When the technology disclosed herein, is employed along with state of the art ph and temperature controls a sustainable system is achieved, under complete control, which enhances quality, saves chemicals, by minimizing overdosing and reduced labor cost.

The process controls described in this disclosure, are applicable to electroless nickel, electroless cobalt, electroless gold, and alloy electroless processes, e.g., nickel/cobalt; nickel/tungsten, since the control parameters is deposit weight and not dependent on the physical or chemical characteristics of the deposit. However, its largest use is expected in electroless nickel plating.

Clearly the technology can be employed in electroplating.

IMPROVEMENT ACHIEVED FROM MONITORING ELECTROLESS PLATING IN REAL TIME

Background of the Invention (1) Field of the Invention (2) Description of the Prior Art.

As the electroless (autocatalytic process) proceeds preweighed and/or pre-thickness-measured coupons are removed at prescribed (or noted) time intervals, at which time they are re-weighed and and/or thickness-remeasured to close tolerances.

The weight and/or thickness gains are manually logged. The operator makes decisions on the amount of replenisher chemicals required based on the profile of weight and/or thickness increase with time.

Tools and equipment used for these tasks are:

Analytical Balance. Micrometer, eddy-current thickness measurement. Magnetic interference instrument.

All of which require withdrawal of coupons at prescribed time intervals, hands-on measurement by factory personnel, often not trained on measurement and quality control statistical methods. Gains in thickness and/or weight are logged manually as a function of time, using multiple coupons as the process continues.

Eddy-current and magnetic instruments require recalibration for alloy changes as the process continues, and these instruments experience deterioration in a chemical environment.

These state of the art methods are labor intensive, have a slow response to a rapidly changing process with no clear quality control or process control record. Also, process controls described in vendor's directions have been found to be confusing. They are based on measuring the area of work plated, through-put and plating time or area to be plated and thickness as a basis for calculating the quantity of replenishing chemicals required to return to optimum operating conditions. All these measurements are unreliable, performed in most cases by factory production personnel.

Procedures for automatic on-line control involve chemical analytical methods for multiple bath constituents, in addition to ph and temperature controls; whereas this disclosure describes a method by which complete process control is achieved using only one parameter in addition to ph temperature control.

To overcome these state-of-the-art deficiencies, a weight method for real time process control of electroless plating is the subject of this disclosure.

The method employs a strain gauge load-cell, galvanometer connected to a computer with terminal emulation software, or connected to a pen recorder, each having the capability to trace profile of weight gain with time.

Since the optimum profile for each electroless nickel formulation is known, it can be programmed into the system. The equipment is automatically tared so only weight gain is displayed. As the equipment reads out weight gain it displays this along with optimum profile, dictating the amount and time for chemical replenishment; at the same time generating quality control hard data.

Without the use of the computer the low (Lo) signal or output of the galvanometer alerts the operator to make replenishment according to profile given in internal engineering specifications.

An additional option is that the computer can be programmed to activate valves e.g., proportinating pump. This development was prompted by the following process experiences. Rate of plating is the most important parameter to control.

When rate decreases, adjustments of ph temperature and additions of the reductant restores rate and deposit quality.

In such a dynamic system, there are other variables that determine deposition rate:

1. Impurities
2. Build up of products of chemical reduction, e.g., phosphates
3. Loss of exaltants, e.g., Succinic Acid mainly through drag out with parts from the bath all of which are determined by chemical analysis or an infrequent bases and are not a major factor in controlling deposition rate. When ph and temperature controls in conjunction with the addition of replenisher chemicals dictated by the real time weight gain readout does not return the deposition rate to the prescribed profile, indications are that the aforementioned variables should be explored.

Since the ph and temperature of the plating bath are significant factors in determining the plating rate, it is clear that the plating rate as determined by employing load-cells as herewith disclosed and can be fed back to control ph and temperature.

A load cell is composed of a weatstone bridge, FIG. 1 one arm of which incorporates a strain (gauge). A strain gauge incorporates a resistive element. It can be fabricated from a semiconductor sensing element wire, foil carbon film, also in rosette form.

BRIEF DESCRIPTION OF DRAWINGS

When a load is imposed on the strain gage arm, the balance of the bridge is disturbed, resulting in a galvanometer deflection as a measure of the imposed load. (FIG. 2) By the use of state-of-the-art terminal emulation software and/or electronics, the readout of weight gain can be done in an area distant from the chemical environment by quality and production trainee personnel. The readout is available on a computer or pen-recorder.

DESCRIPTION OF THE PREFERRED EMBODIMENT

Figure 1:
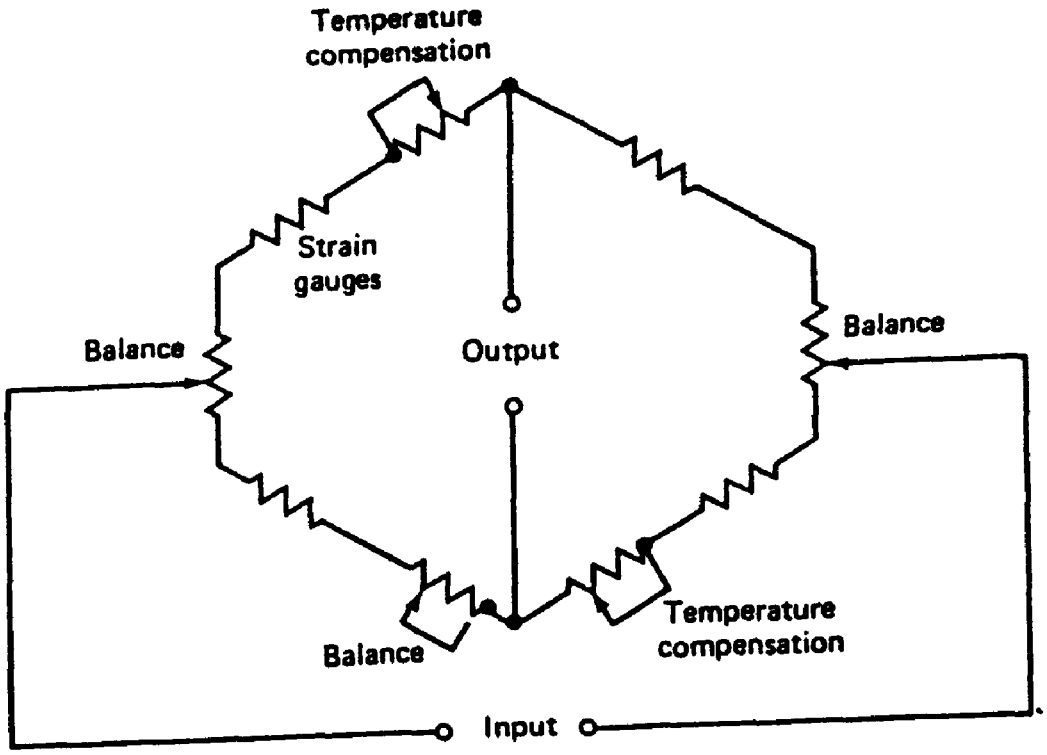
FIG. 1 Schematics Wheatstone Bridge of Load Cell.
Figure 2:
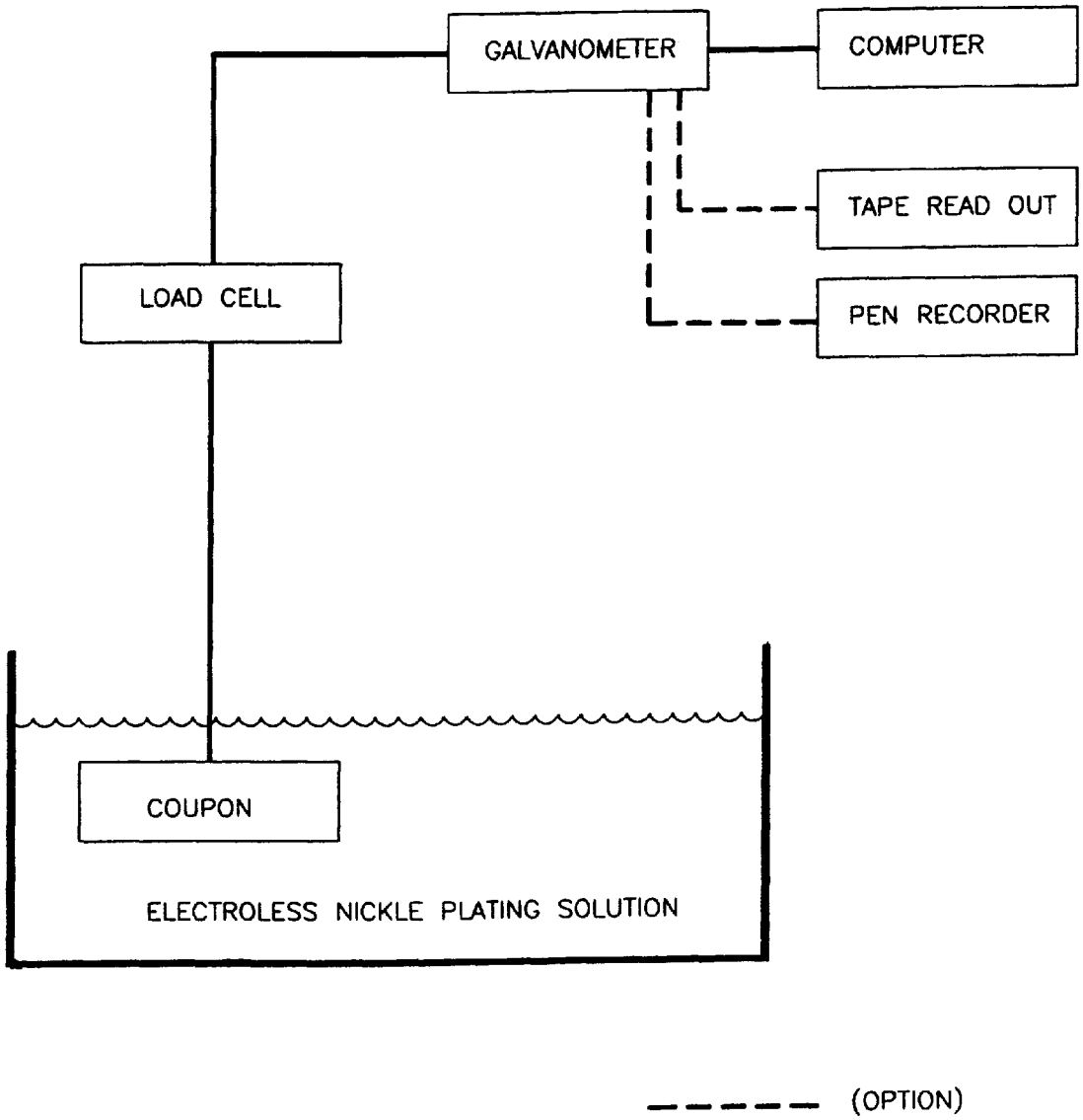
FIG. 2 Servo Controls with Load Cell
Figure 3:
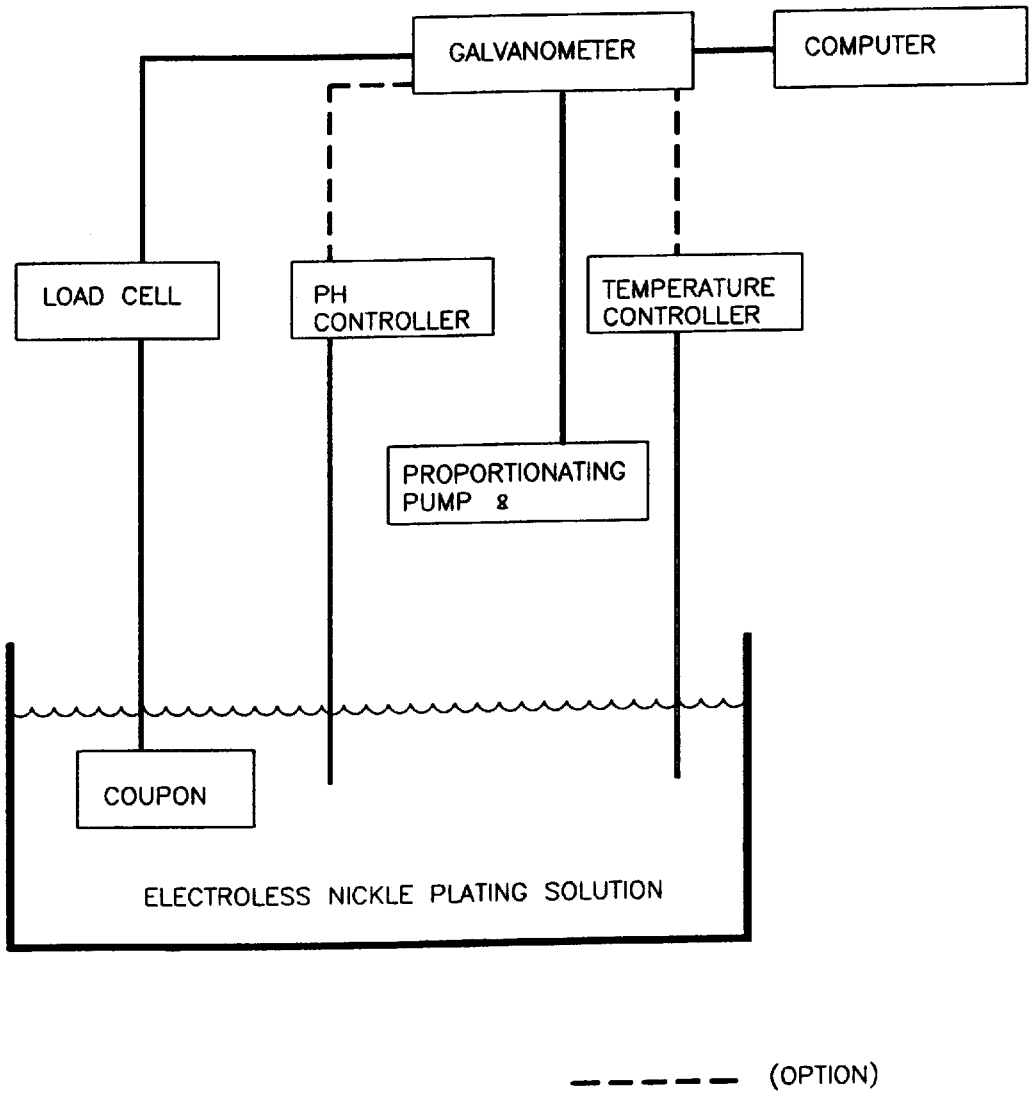
FIG. 3 Tank with Servo Controls for Temperature, ph and Sample Weight.

A detailed diagram of plating tank with servo-controls necessary to achieve monitoring and process control according to this disclosure is shown in FIG. 3

Figure 4B:
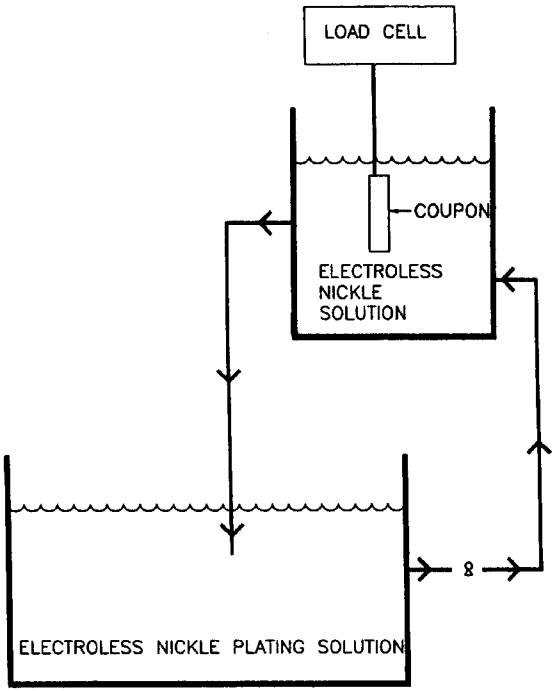
FIG. 4B Tank as in FIG. 3 with Separate Tank in Series.
Figure 4A:
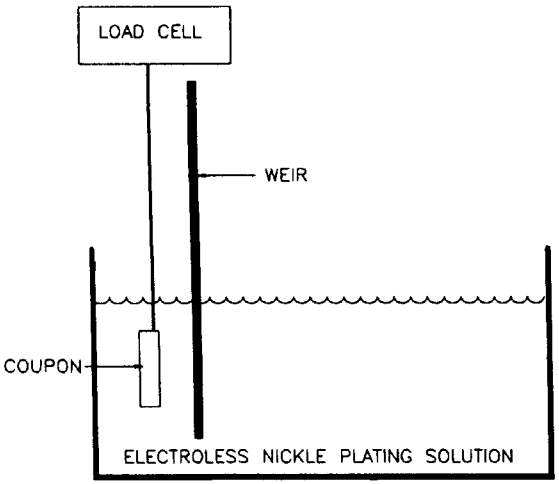
FIG. 4A Tank as in FIG. 3 with Weir.

It may be required, under certain circumstances, e.g., removal and insertion of large items into the plating tank or heat convection, each of which can cause sufficient turbulence to cause erratic weight reading, to employ a weir design (FIG. 4A or a separate tank in series with the plating tank (FIG. 4B) to protect the sample from turbulence.

An electroless plating bath was prepared and operated under the following conditions:

| FORMULATIONS | |
|---|---|
| | Grams/Liter |
| Nickel Sulfate | 30 |
| Malic Acid | 24 |
| Citric Acid | 2 |
| Succinic Acid | 12 |
| Lead | 1.2 ppm |
| ph | 4.4 |
| Temperature | 200° F. |
| Volume | 380 liters |
| Plating Rate (0.0007 in/hour) | 1.54 grams/dm$^2$/hr |

Representing a typical production formulation. When the bath attained operating temperature 30 grams of Sodium Hypophosphite was added for every liter of plating bath.

A replenishment solution (A) was prepared:

| SOLUTION A | |
|---|---|
| | Grams/Liter |
| Nickel Sulfate | 150 |
| Sodium Hypophosphite | 150 |
| ph | 8.0 |

Under these conditions the plating rate is 1.54 grams/decimeter per hour (0.0007 inch per hour).

| | Grams/Liter |
|---|---|
| MAKE UP CONCENTRATE E | |
| Lead -- 5 ppm | |
| Succinic Acid | 120 |
| Malic Acid | 240 |
| Citric Acid | 10 |
| ph | 4.0–4.5 |
| SOLUTION C -- PH ADJUSTER | |
| 10%/v | Ammonia Hydroxide |

The following Equipment was employed:

| | |
|---|---|
| Load Cell: | ELF 1000/26 series (0–2 pounds.) Manufactured by Entran -- full deflection = 250 mV |
| Yields deflection of: | 0.1 millivolt per 0.1 grams |
| Connected to: | MM35 3½ inch digital transducer meter powered by 10 millivolt excitement supply mfg. Entran Electronics (see FIG. I) |
| Operating Parameters | |
| Plating Rate: | 1.54 grams/decimeter |
| Deposition Rate: | 0.026 grams/dm$^2$ per minute; 0.0007 inch/hour |
| Load Cell Tare: | 62.7 grams |
| Coupon Dimensions: | 19.67 cm × 9.8 cm = 387 dm$^2$ |

In this sample cited in a sample coupon (67.3 grams, 387 dm$^2$) was employed. With spanning of the signal from the weight meter sufficient resolution is achieved. However, it is obvious that this choice is arbitrary and not based on any consideration other than the convenience of the demonstration tank size, etc. It is also obvious that there is no limit on the weight or area of the sample chosen and when a large sample area is used, no spanning would be required to get sufficient resolution to read directly on the galvanometer. spanning of the signal was achieved by employing a "Newport Infinity Strain Gage 6 Digit Meter."

| Method of Data | Examples |
|---|---|
| Recording | 1st Turnover -- Manual Logging from galvanometer<br>2nd T.O.A -- Automatic Replenisher Automatic Tare<br>2nd T.O. w/o -- Replenisher Ads<br>2nd T.O. -- With steady state additions<br>1–7 T.0.'s -- with low control of galvanometer |

The following log was kept, recording the profile of a th of optimum performance, to be compared to future bath mance (Turn-over #1). A Turn-over is the exhaustion (plating-out) of all the metal contained in the solution. This is culated, since in practice a bath is not allowed to proceed that far without replenishment.

EXAMPLE #1

Log Representing 1st Turn-over of Bath with the Following Parameters.

| | | |
|---|---|---|
| Deposition: Rate | 1.54 grams/dm$^2$/hour or 0.027 g/dm$^2$/min | (0.0007 inch/hour) Deflection of meter 1 gram = 0.36 Mv |
| | ph - 4.4 | |
| | Temperature - 200° F. | |
| Coupon Tare: | 62.7 grams - [19.67 cm × 9.8 cm] × 2 sides = 387 dm$^2$ | |
| | thickness - 0.02 cm | |

| Time Minutes | Reading Mv | Wt Total (g) | Grams/ dm$^2$ | Grams deposited | Additions changes |
|---|---|---|---|---|---|
| 0 | 22.572 | 62.7 | 0.16200 | | |
| 1 | 22.581 | 62.726 | 0.16208 | .026 | |
| 5 | 22.619 | 62.83 | 0.1623 | .13 | |
| 15 | 22.71 | 63.09 | 0.1630 | 0.39 | |
| 20 | 22.75 | 63.22 | 0.1634 | 0.52 | |
| 30 | 22.85 | 63.48 | 0.164 | 0.78 | |
| 40 | 22.95 | 63.74 | 0.1647 | 1.04 | |
| 50 | 23.04 | 64.00 | 0.1653 | 1.3 | |
| 60 | 23.1264 | 64.24 | 1.660 | 1.56 | |

EXAMPLE #2

Figure 5:
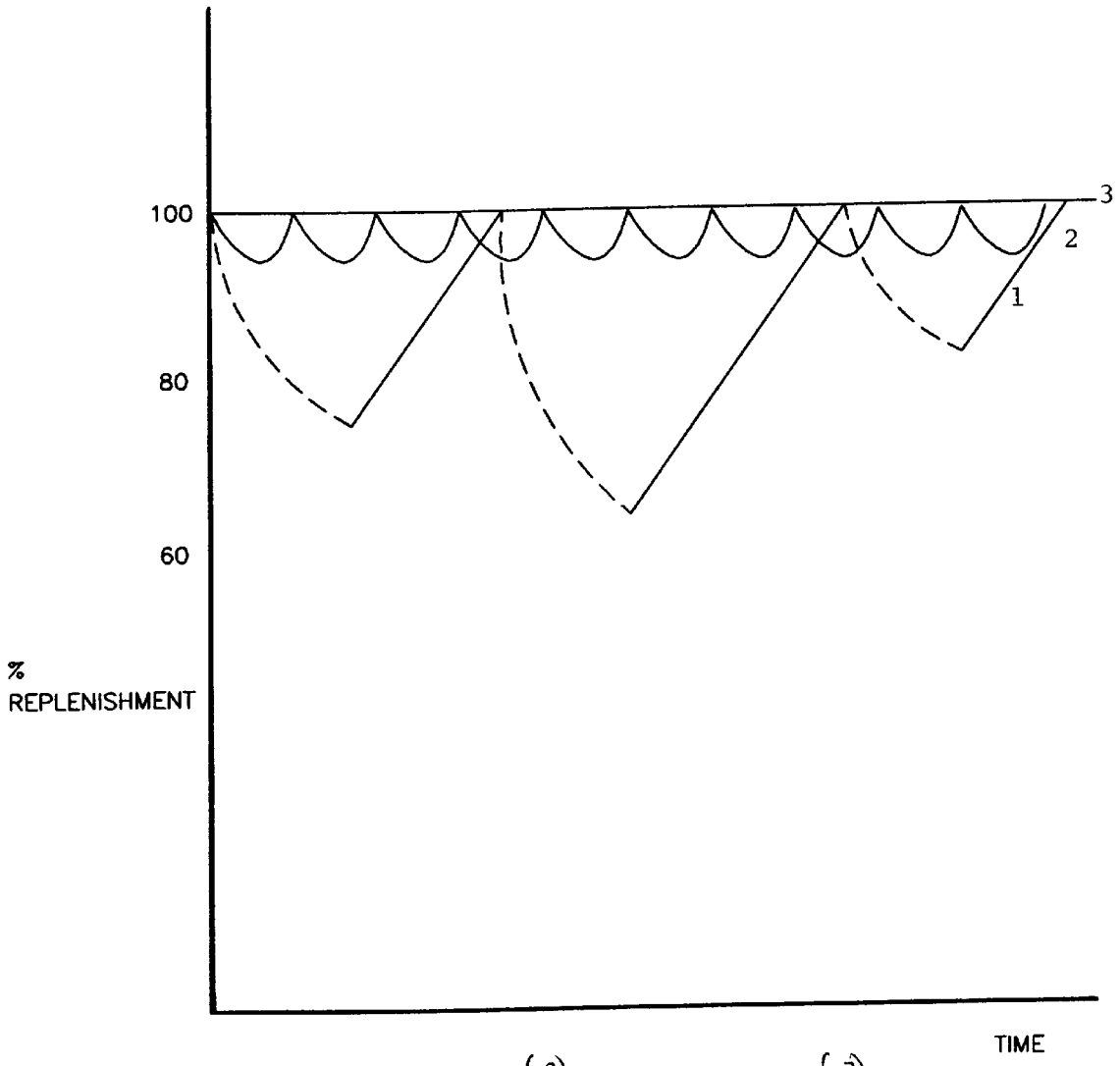
FIG. 5 Profile of Manual, Automatic and Steady State Replenisher Additions.

2nd Turn-over Replenisher every 5 minutes with Automatic Tare. FIG. 5

| Time Minutes | Reading Mv | Grams deposited | Addition changes |
|---|---|---|---|
| 0 | | | to 380L |
| 1 | .0094 | 0.26 | |
| 5 | .043 | 0.12 | |
| 15 | .133 | 0.37 | |
| 20 | .156 | 0.48 | |
| 30 | .281 | 0.78 | |
| 40 | .360 | 1.00 | |
| 50 | .425 | 1.18 | |
| 60 | .612 | 1.70 | |

EXAMPLE #3

Figure 6:
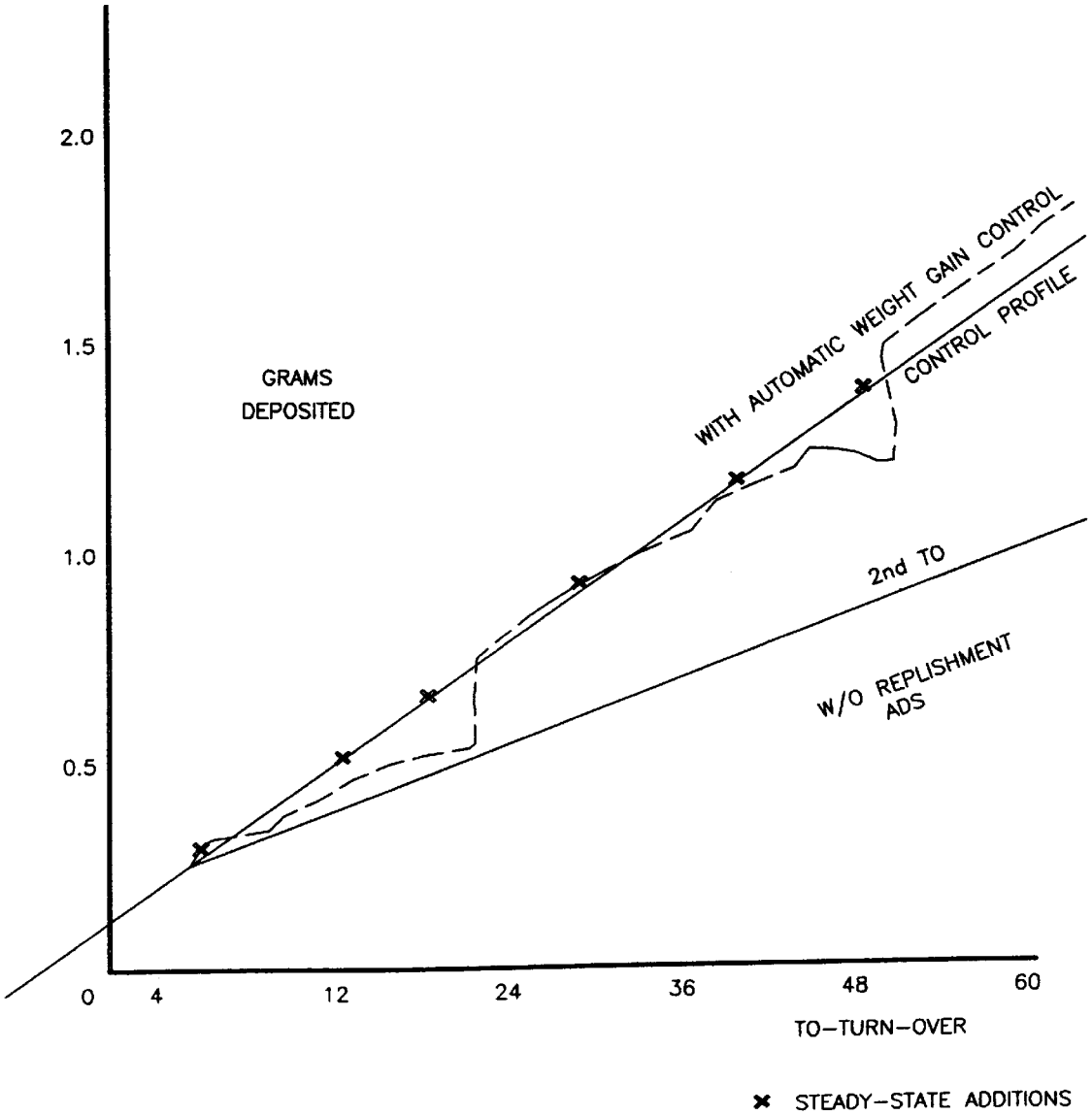
FIG. 6 Control Profile of Replenisher Additions.

2nd Turn-over No Replenisher with Automatic Tare. FIG. 6.

| Time Minutes | Reading Mv | Grams deposited |
|---|---|---|
| 0 | | |
| 1 | .0090 | 0.025 |
| 5 | .043 | 0.12 |
| 15 | .100 | 0.28 |
| 20 | .137 | 0.38 |
| 30 | .162 | 0.45 |
| 4o | .256 | 0.72 |
| 50 | .317 | 0.88 |
| 60 | .388 | 1.08 |

Notes:
MM35 -- meter -- coupon tare 62.7 grams -- 387 dm$^2$ -- 1 gram = 0.36 Mv; ph: 4.2–4.4; temperature 194° F.–200° F. -- Bath vol. 380 liters; 15 mls of replenisher B added during both 2nd T.O.; Nickel 26–34 grams/liter.
Meter Reading for Automatic Replehisher A Additions -- 5.5 liters (2nd T.O.).

EXAMPLE #4

2nd Turn-over Automatic Tare Steady State Additions [A Constant Flow Rate Make-up 100 mls/minutes of Replenisher A] FIG. 5. FIG. 6

| Time Minutes | Reading Mv | Grams deposited |
|---|---|---|
| 0 | | |
| 1 | 0.10 | 0.28 |
| 5 | 0.97 | 0.27 |
| 15 | 0.134 | 0.38 |
| 20 | 0.184 | 0.51 |
| 30 | 0.280 | 0.80 |
| 40 | 0.371 | 1.03 |
| 50 | 0.547 | 1.32 |
| 60 | 0.569 | 1.58 |

EXAMPLE #5

Direct Control Employing the Hi/Lo Alarm of MM35 Digital Transducer Meter Powered by 10 millivolt Excitement Supply A sample of a run following plant engineering specifications established in laboratory from the teachings of this disclosure.

For formulation and operating procedure (see detailed explanation) "Lo" set for each T.O. as shown (or hour of operation).

| PROFILE | | | | | | | |
|---|---|---|---|---|---|---|---|
| Turn-over | Hours | I Plating Rate Thickness Inches/ Hour | II Grams/ dm$^2$/ hour | ph | Tem-pera-ture (° F.) | Additions/380L A (liters*) | ((mls)) |
| 1 | 1 | 0.0007 | 0.026 | 4.4 | 200 | 2 | |
| 2 | 2 | 0.00065 | 0.024 | 4.2 | 197 | 4 | 10 |
| 3 | 3 | 0.00059 | 0.022 | 4.3 | 202 | 4 | |
| 4 | 4 | 0.00053 | 0.020 | 4.1 | 196 | 1 | |
| 5 | 5 | 0.00050 | 0.019 | 4.0 | 200 | 0.5 | |

-continued

| PROFILE | | | | | | | |
|---|---|---|---|---|---|---|---|
| | | I Plating Rate Thickness | II Grams/ | | Tem-pera- | Additions/380L | |
| Turn-over | Hours | Inches/ Hour | $dm^2$/ hour | ph | ture (° F.) | A (liters*) | ((mls)) |
| 6 | 6 | 0.00048 | 0.018 | 3.9 | 202 | 3 | |
| 7 | 7 | 0.00043 | 0.016 | 4.0 | 200 | 2 | |

*The Lo Control Alarm alerts operator to consult Column II and make additions of Replenisher A until rate returns to specification; also check ph and temperature.

or

Lo control can be set to activate proportionating pump.

Complete chemical analysis for nickel, sodium hypophospite every T.O.

Analysis for phosphate and impurities (copper, iron and zinc after 4th T.O.

T.O. -turnover—approximately equivalent to hours of operation

We claim:

1. A method for continuously monitoring and controlling an alloy electroless plating process in real time comprising the steps of:

completely immersing into a plating solution a pre-weighted coupon of a known surface area, said coupon being attached to load cell;

continuously monitoring by the load cell the weight change of the immersed coupon as the alloy electroless plating proceeds to control the plating rate of the plating process.

2. The method of claim 1, further comprising a step of controlling the alloy electroless plating process by replenishing the plating solution according to a specific profile.

3. The method of claim 1, wherein a weight change of a coupon impresses a changed stress on a load cell.

4. The method of claim 1, wherein the controling is performed by a device comprising a coupon suspended from a load cell.

* * * * *